US008331607B2

(12) United States Patent
Onodera

(10) Patent No.: US 8,331,607 B2
(45) Date of Patent: Dec. 11, 2012

(54) SPEAKER

(75) Inventor: Noboru Onodera, Nagano (JP)

(73) Assignee: Minebea Co., Ltd., Nagano (JP)

( * ) Notice: Subject to any disclaimer, the term of this patent is extended or adjusted under 35 U.S.C. 154(b) by 259 days.

(21) Appl. No.: 12/835,129

(22) Filed: Jul. 13, 2010

(65) Prior Publication Data

US 2011/0019865 A1 Jan. 27, 2011

(30) Foreign Application Priority Data

Jul. 24, 2009 (JP) ..... 2009-173368
Jan. 15, 2010 (JP) ..... 2010-007285
May 18, 2010 (JP) ..... 2010-114659

(51) Int. Cl.
*H04R 1/00* (2006.01)
*H04R 9/06* (2006.01)
*H04R 11/02* (2006.01)

(52) U.S. Cl. ..... 381/423; 381/398; 381/404; 381/412

(58) Field of Classification Search ..... None
See application file for complete search history.

(56) References Cited

U.S. PATENT DOCUMENTS 5,740,264 A * 4/1998 Kojima ..... 381/423
7,672,473 B2 * 3/2010 Horigome et al. ..... 381/433
7,801,324 B2 * 9/2010 Kimura et al. ..... 381/430
2008/0137902 A1 * 6/2008 Bohlender et al. ..... 381/420
2008/0232633 A1 * 9/2008 Corynen ..... 381/396
2009/0041291 A1 * 2/2009 Toyofuku et al. ..... 381/398
2011/0019865 A1 * 1/2011 Onodera ..... 381/423
2011/0194724 A1 * 8/2011 Watanabe et al. ..... 381/398
2012/0002837 A1 * 1/2012 Ouchi ..... 381/412

FOREIGN PATENT DOCUMENTS

EP 2111057 A2 * 10/2009
JP S57-43693 U 3/1982
JP S59-183096 U 12/1984
JP S62-143398 U 9/1987
JP H4-53114 U 12/1992
JP 2000-004498 A 1/2000
JP 2006-311156 A 11/2006

* cited by examiner

*Primary Examiner* — Marlo Fletcher
(74) *Attorney, Agent, or Firm* — Carrier Blackman & Associates, P.C.; Joseph P. Carrier; William D. Blackman

(57) ABSTRACT

A speaker includes an elongated diaphragm and a coupling member including forward and rearward segments, wherein at least two protrusions are provided at the rear side of the diaphragm along the major axis direction, the forward segment is engagingly disposed between the opposing end faces of two adjacent protrusions and also between the two portions of a rib of the diaphragm opposing each other in the minor axis direction, and wherein the outer circumferential surface of the voice coil bobbin is connected to the inner circumferential surface of the rearward segment, whereby the voice coil bobbin having a diameter larger than the dimension of the diaphragm measured along the minor axis direction can be successfully attached to the diaphragm. In the speaker described above, the diameter of the voice coil bobbin can be increased without decreasing the width of a surround thus enabling the withstanding of higher power input.

11 Claims, 22 Drawing Sheets

SPEAKER

BACKGROUND OF THE INVENTION

1. Field of the Invention

The present invention relates to a speaker.

2. Description of the Related Art

Speakers are widely used not only in home audio equipment or a car audio system but also in various electronic devices, such as a personal computer, a mobile phone, a video game machine and the like. Such electronic devices are increasingly downsized, which calls on the speakers to be further downsized (lower profile) and provide enhanced performance, specifically to withstand higher power input as well as produce improved sound quality.

Due to the limited installation space allocated for a speaker in an electronic device, the speaker is forced to have an elongated geometry and at the same time required to withstand high power input. Such a speaker with an elongated shape has a limited minor axis dimension and is therefore prohibited from having a voice coil with a sufficiently large diameter thus being disadvantageous in terms of withstanding power input. If the diameter of the voice coil is increased without changing the minor axis dimension of the speaker, the width of a surround is forced to decrease accordingly, and therefore the amplitude of a diaphragm is limited, which results in preventing the speaker from withstanding high power input. Also, if the width of the surround is decreased, the lowest resonance frequency is increased, and the reproductive performance in the lower frequency is deteriorated.

FIG. 20 shows a cross section of a conventional elongated speaker 201, wherein the cross section of the speaker 201 taken along the minor axis direction is shown in the left side and the cross section thereof taken along the major axis direction is shown in the right side. The speaker 201 shown in FIG. 20 includes: a frame 202; a magnetic circuit 203 connected to the frame 202; a voice coil 204 suspended in a magnetic gap of the magnetic circuit 203; a surround 205 whose outer circumferential portion is connected to the frame 202; a diaphragm 206 which has its outer circumferential portion connected via the surround 205 to the frame 202 and which vibrates back and forth (vertically in the figure) together with the voice coil 204; a spider 207 which has its inner circumferential portion connected to the voice coil 204 and has its outer circumferential portion connected to the frame 202; and a center cap 208 to cover the front side (upper side in the figure) of the voice coil 204.

In the speaker 201 of FIG. 20, if the diameter of the voice coil 204 is increased in order to withstand high power input, the width of the surround 205 is further decreased thus increasing the lowest resonance frequency, and the reproductive performance in the lower frequency is deteriorated. In order to overcome the problem described above, a solution is proposed in Japanese Patent No. 3956485.

FIG. 21A shows a cross section of an elongated speaker 301 disclosed in Japanese Patent No. 3956485, and FIG. 21B shows perspectively a relevant portion of the speaker 301. In FIG. 21A, the cross section of the speaker 201 taken along the minor axis direction is shown in the left side and the cross section thereof taken along the major axis direction is shown in the right side like in FIG. 20.

Referring to FIGS. 21A and 21B, in the speaker 301, a voice coil 302 is disposed and located outward of the inner circumference of a surround 303 at the minor axis direction area, and parts 305 of the front end portion of the voice coil 302 are cut off to prevent the voice coil 302 from making contact with the surround 303, which enables the diameter of the voice coil 302 to be successfully increased without decreasing the width of the surround 303 positioned at the minor axis direction area thereby ensuring the withstanding of high power input.

Another solution for the problem described above is proposed in Japanese Patent Application Laid-Open No. 2006-311156. FIG. 22 shows a cross section of a conventional speaker 401 disclosed in Japanese Patent Application Laid-Open No. 2006-311156. In the speaker 401 shown in FIG. 22, a voice coil bobbin 403 has a larger diameter than a diaphragm (center dome) 402, an extension member 404 is disposed between the voice coil bobbin 403 and the diaphragm 402, and an inner circumferential portion of a surround (peripheral dome) 405 is connected to the extension member 404.

In the speaker 401 of FIG. 22, with provision of the extension member 404, the width of the surround 405 does not have to be decreased even if the diameter of the voice coil bobbin 403 is increased, and so the withstanding of power input can be increased.

In the speaker 301 disclosed in Japanese Patent No. 3956485, however, the process of cutting off the parts 305 of the front end portion of the voice coil 302 is additionally required, and also the workability in assembling the speaker 301 is deteriorated because the voice coil 302 has to be set in place with respect to the circumferential direction because of the provision of the parts 305 cut off. These factors can lead to the increase of the component cost and the product cost.

Also, in the speaker 401 disclosed in Japanese Patent Application Laid-Open No. 2006-311156, the extension member 404 is a flat plate having in top plan view a substantially elongated ring shape corresponding to the voice coil bobbin 403 and therefore cannot be applied to an elongated speaker including a normal round voice coil. Further, the speaker 401 is a micro speaker with no spider and so is inferior in the reproductive performance in the lower frequency.

SUMMARY OF THE INVENTION

The present invention has been made to overcome the problems described above, and it is an object of the present invention to provide a speaker which, without increasing the component cost and production cost, is excellent in the withstanding of power input and in the bass reproductive performance and can be reduced in size and profile.

In order to achieve object described above, according to an aspect of the present invention, there is provided a speaker which includes: a diaphragm having an elongated shape defining a major axis direction and a minor axis direction; a spider; a frame disposed outward radially and rearward of the diaphragm; a surround whose inner circumference is connected to the diaphragm and whose outer circumference is connected to the frame; a magnetic circuit disposed rearward of the diaphragm and connected to the frame; a voice coil bobbin; a voice coil wound around the outer circumferential surface of the voice coil bobbin, and suspended in a magnetic air gap of the magnetic circuit; and a coupling member connected to the rear side of the diaphragm and also to the voice coil bobbin, wherein the outer dimension of the voice coil bobbin measured along the minor axis direction is larger than an outer dimension of the diaphragm measured along the minor axis direction.

According to the present invention, a speaker which can be reduced in size and lowered in profile and at the same time is excellent in withstanding of high power input and bass reproductive performance can be provided without increasing component cost and production cost.

DETAILED DESCRIPTION OF THE INVENTION

An exemplary embodiment of the present invention will hereinafter be described with reference to the accompanying drawings.

Figure 1:
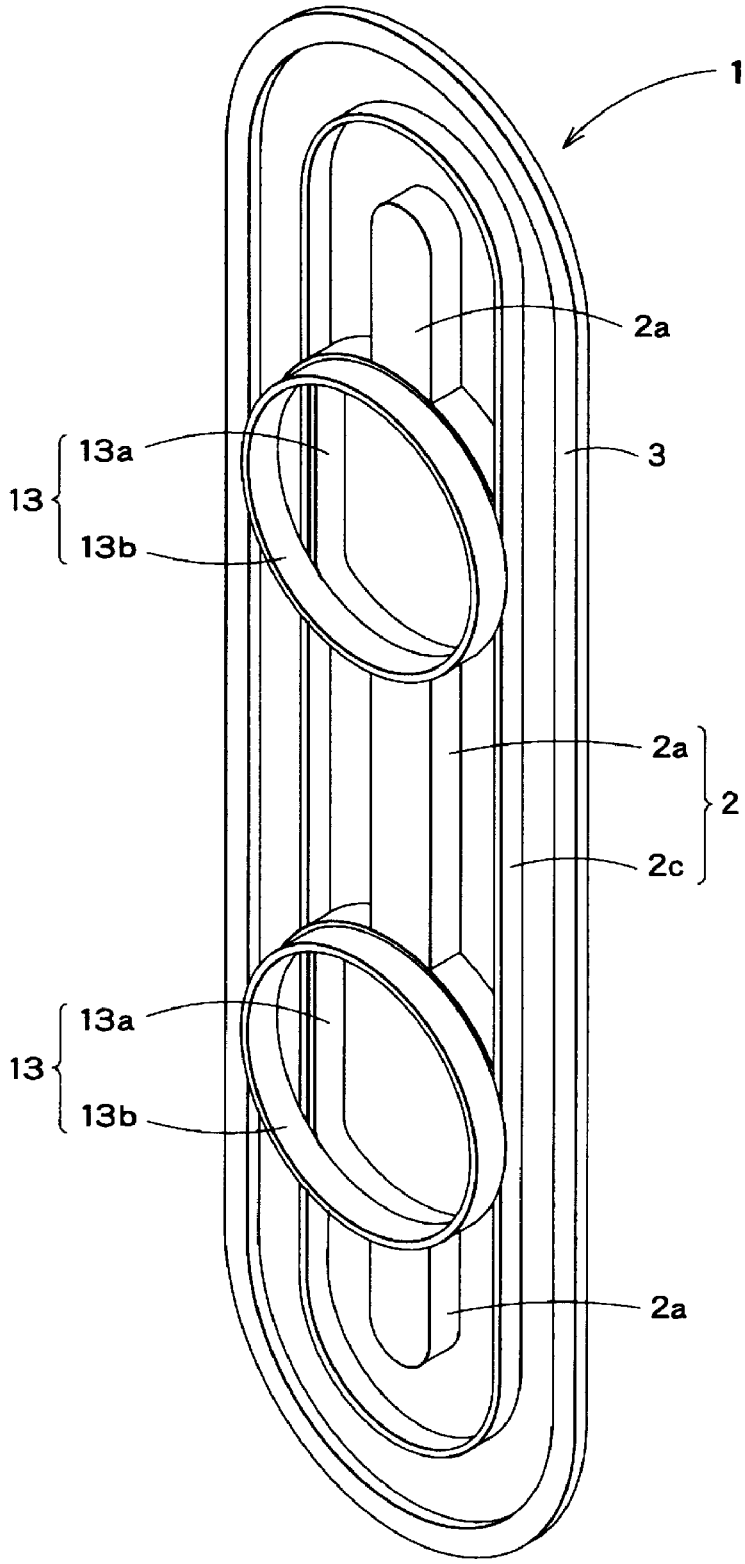
FIG. 1 is a perspective view of a relevant portion of a speaker according an embodiment of the present invention seen from a rear side.
Figure 2:
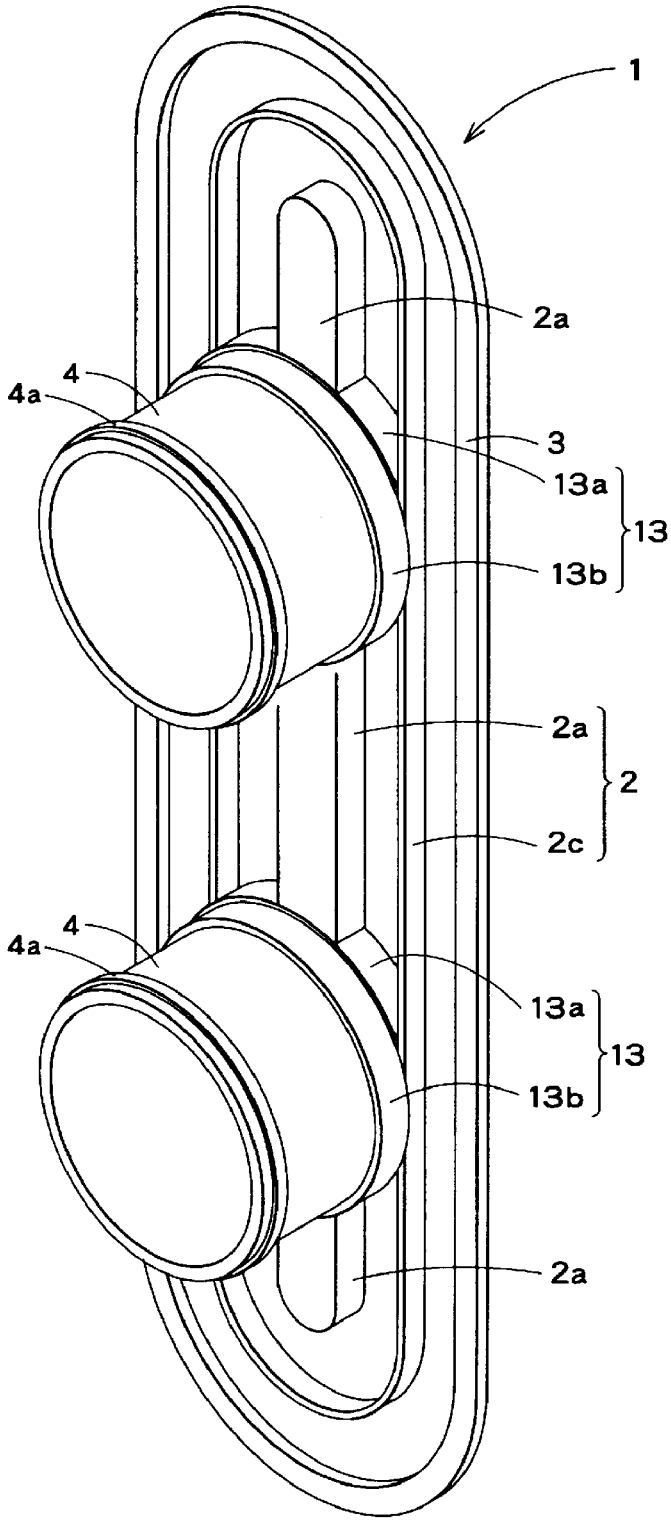
FIG. 2 is a perspective view of the speaker of FIG. 1, additionally showing voice coil bobbins duly attached.

FIG. 1 shows perspectively a relevant portion of a speaker 1 according to an embodiment of the present invention seen from a rear side, wherein a voice coil bobbin, a spider, a frame and a magnetic circuit are omitted for the convenience purpose. FIG. 2 shows perspectively the speaker 1 of FIG. 1 together with two voice coil bobbins each having a voice coil wound therearound.

Referring to FIGS. 1 and 2, the speaker 1 according to the present embodiment includes a diaphragm 2 having an elongated shape defining a major axis direction and a minor axis direction, a surround 3 having an elongated ring shape and disposed to enclose the diaphragm 2, and two voice coil bobbins 4 attached at a rear side of the diaphragm 2.

An inner circumference of the surround 3 is connected to the diaphragm 2, and an outer circumference of the surround 3 is connected to a frame (not shown in FIGS. 1 and 2). The speaker 1 further includes two voice coils 4*a* which are each wound respectively around the voice coil bobbin 4 and are each suspended in a magnetic gap of a magnetic circuit (not shown in FIGS. 1 and 2).

One of the technical features of the present invention is that the speaker 1 includes at least one (two in the embodiment) coupling member 13 disposed to connect between the diaphragm 2 and the voice coil bobbin 4. The coupling member 13 will be described in details.

Figure 3A:
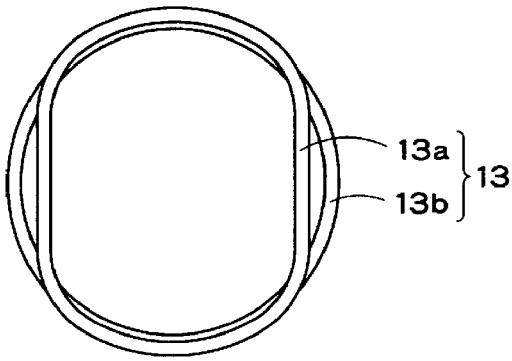
FIG. 3A is a plan view of a coupling member of the speaker of FIG. 1 seen from a front side.
Figure 3B:
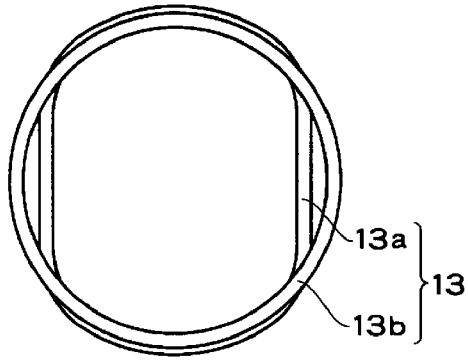
FIG. 3B is a plan view of the coupling member seen from the rear side.
Figure 3C:
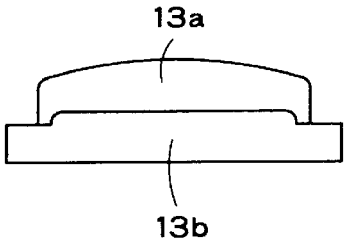
FIG. 3C is a side view of the coupling member seen from a lower side in FIG. 3A.
Figure 3D:
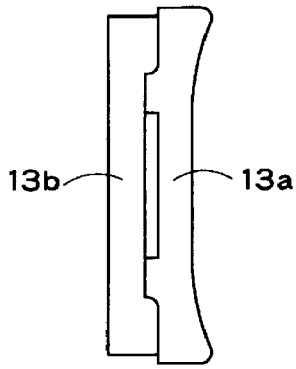
FIG. 3D is a side view of the coupling member seen from a right or left side in FIG. 3A.

FIGS. 3A to 3D show various structural aspects of the coupling member 13, wherein FIG. 3A shows a front side, FIG. 3B shows a rear side, FIG. 3C show a side seen from the lower side in FIG. 3A, and FIG. 3D shows a side seen from the right or left side in FIG. 3A.

The coupling member 13 has a two-stage structure composed of a forward segment 13*a* located toward the front side of the speaker 1 and a rearward segment 13*b* disposed toward the rear side of the speaker 1, wherein the forward segment 13*a* and the rearward segment 13*b* are formed integrally with each other. The forward segment 13*a* is a ring member having an oval racetrack shape and has a larger dimension measured along the major axis direction of the speaker 1 than measured along the minor axis direction thereof. The rearward segment 13*b* is a ring member having a substantially circular shape. As shown from FIGS. 3A and 3C, the rearward segment 13*b* has a larger dimension (diameter) than the forward segment 13*a* with respect to the minor axis direction of the speaker 1. On the other hand, as shown from FIGS. 3B and 3D, the forward segment 13*a* has a slightly larger dimension than the rearward segment 13*b* with respect to the major axis direction of the speaker 1.

The forward segment 13*a* of the coupling member 13 is connected to the diaphragm 2 as shown in FIG. 1, and the rearward segment 13*b* thereof is connected to the voice coil bobbin 4 as shown in FIG. 2. Thus, the diaphragm 2 and the voice coil bobbin 4 are fixedly connected to each other via the coupling member 13, which constitutes one of the features of the present invention.

When the coupling member 13 is connected to the diaphragm 2 and the voice coil bobbin 4, adhesive is applied to at least one of the coupling member 13 and the diaphragm 2/the voice coil bobbin 4. There is no specific limitation in terms of connection mode.

Figure 4A:
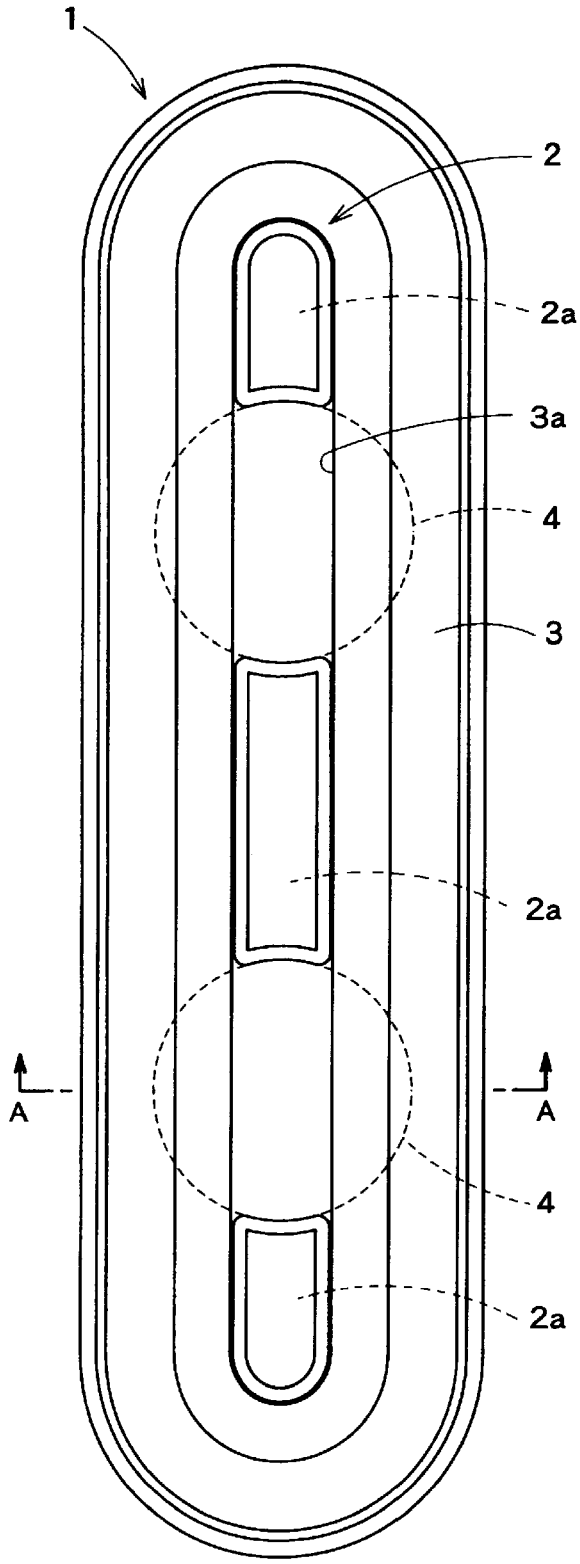
FIG. 4A is a plan view of the speaker according to the embodiment shown with a frame removed, seen from the front side.
Figure 4B:
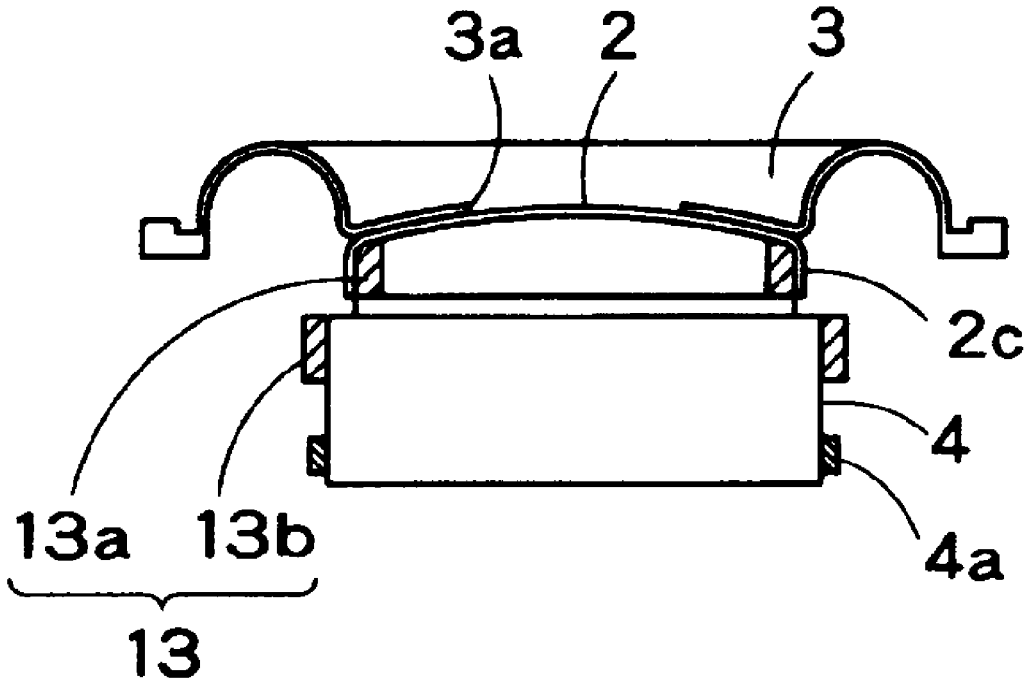
FIG. 4B is a cross sectional view of the speaker of FIG. 4A taken along A-A.
Figure 5A:
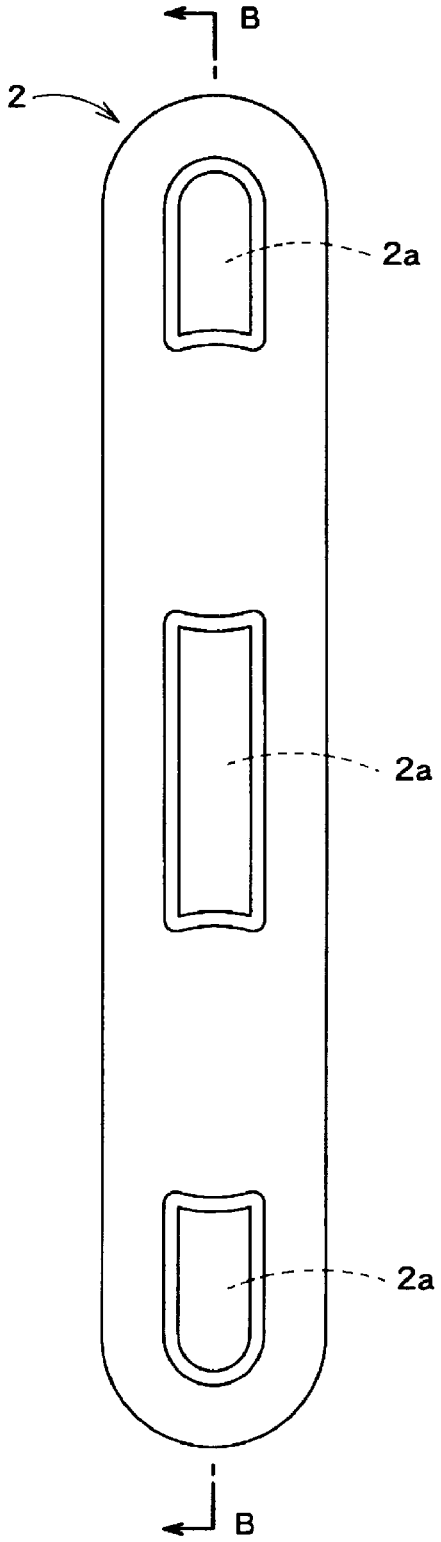
FIG. 5A is a plan view of a diaphragm of the speaker of FIG. 1 seen from the front side.
Figure 5B:
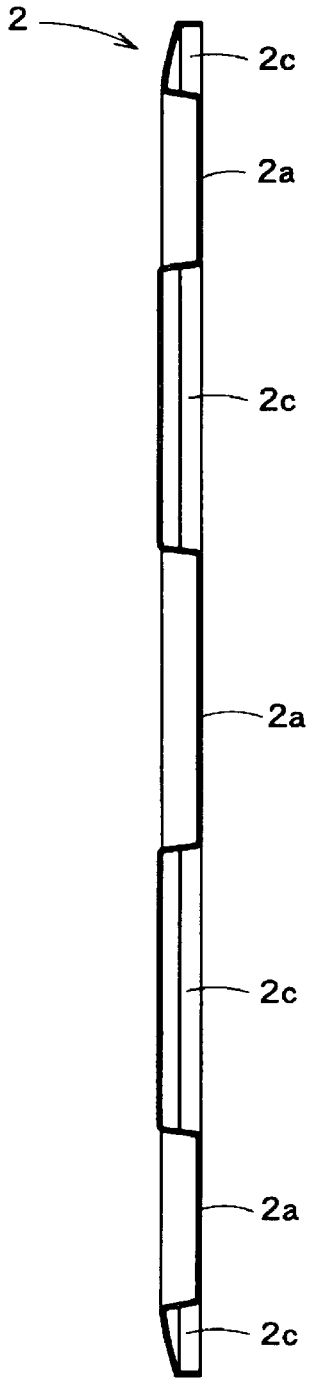
FIG. 5B is a cross sectional view of the diaphragm of FIG. 5A taken along B-B.

FIG. 4A shows a front side of the speaker 1 omitting a frame, and FIG. 4B shows a cross section of the speaker 1 of FIG. 4A taken along A-A. Also, FIG. 5A shows a front side of the diaphragm 2, and FIG. 5B shows a cross section of the diaphragm 2 of FIG. 5A taken along B-B.

Since the voice coil bobbin 4 is disposed at the rear side of the diaphragm 2 as shown in FIG. 2, the voice coil bobbin 4 is indicated by a dashed line in FIG. 4A showing the front side. Referring to FIGS. 5A and 5B, three protrusions 2*a* are formed at the rear side of the diaphragm 2 along the major axis direction, which results in forming three recesses when viewed from the front side of the diaphragm 2. Also, the diaphragm 2 includes a rib 2*c* formed along an outer periphery thereof so as to extend rearward therefrom. The forward segment 13*a* of the coupling member 13 is disposed between two adjacent protrusions 2*a* and between two opposing portions of the rib 2*c* such that the forward segment 13*a* makes contact with the opposing end faces of the two adjacent protrusions 2*a* and also with the inner surfaces of the rib 2*c* at the two portions opposing each other in the minor axis direction. The front side of the forward segment 13*a* of the coupling member 13 is shaped according to the shape of the rear side surface of the diaphragm 2 and thereby fittingly connected to the diaphragm 2. Also, an inner circumferential surface of the rearward segment 13*b* of the coupling member 13 is connected to the outer circumferential surface of the voice coil bobbin 4.

The inner circumferential surface of the rearward segment 13*b* of the coupling member 13 is connected to the outer circumferential surface of the voice coil bobbin 4 in FIG. 4B, but alternatively an outer circumferential surface of the rearward segment 13*b* of the coupling member 13 may be connected to an inner circumferential surface of the voice coil bobbin 4.

There is no specific limitation in material used for the coupling member 13, but a light-weight and hard material is preferred, and, for example, resin is used. Also, for example, adhesive is used for connection between the forward segment 13*a* of the coupling member 13 and the diaphragm 2 and also for connection between the rearward segment 13*b* and the voice coil bobbin 4.

The diaphragm 2 including the protrusions 2*a* and the rib 2*c* is integrally structured of a single material, for example, paper, resin or the like, but there is no specific limitation in material selection.

Referring to FIG. 4B, the diaphragm 2 is gently curved forward with respect to the minor axis direction so that the foremost portion is located at the center of the minor axis direction.

The surround 3 is connected to a front face of the outer circumference of the diaphragm 2 such that an inner circumferential rim 3*a* of the surround 3 is located inward of the outer periphery of the diaphragm 2. Also, as shown in FIG. 4B, the voice coil bobbin 4 connected to the rearward segment 13*b* of the coupling member 13 has a dimension (diameter) larger than the inner dimension of the surround 3 with respect to the minor axis direction. The outer circumference of the voice coil bobbin 4 is not in contact with the surround 3.

Consequently, according to the present embodiment, the voice coil bobbin 4 is allowed to have an increased outer dimension (diameter). That is to say, under the circumstances that the outer diameter of the rearward segment 13*b* of the coupling member 13 must be increased in order to allow the increase of the outer diameter of the voice coil bobbin 4, the rearward segment 13*b* of the coupling member 13 is prevented from interfering with the surround 3 even if the outer diameter of the rearward segment 13*b* is increased for the purpose of allowing the outer diameter of the voice coil bobbin 4 to be increased, and therefore the width of the surround 3 is not forced to decrease due to the increase of the outer diameter of the rearward segment 13*b* of the coupling member 13, which prevents the conventional problem that the lowest resonance frequency increases due to the decrease of the width of the surround 3 when the diameter of the voice coil bobbin 4 is increased.

As described above, according to the present embodiment, even when the outer diameter of the voice coil bobbin 4 is increased, the width of the surround 3 is not influenced. Accordingly, the diameter of the voice coil 4 can be readily increased as required.

Figure 6A:
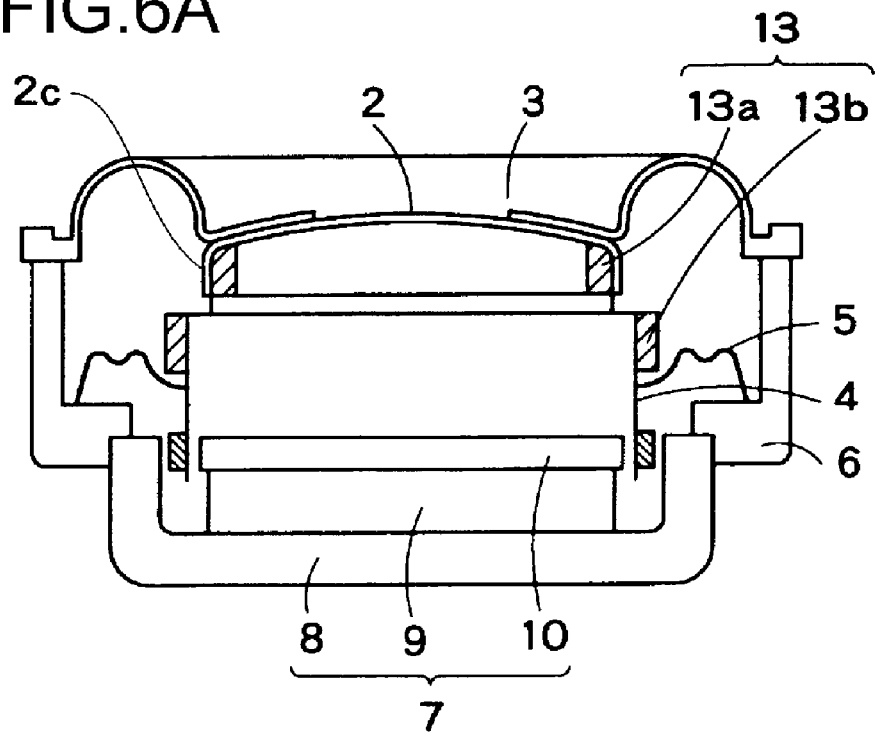
FIG. 6A is a cross sectional view of the speaker including structures shown in preceding drawings, complete with a spider, a frame and an inner magnet type magnetic circuit.
Figure 6B:
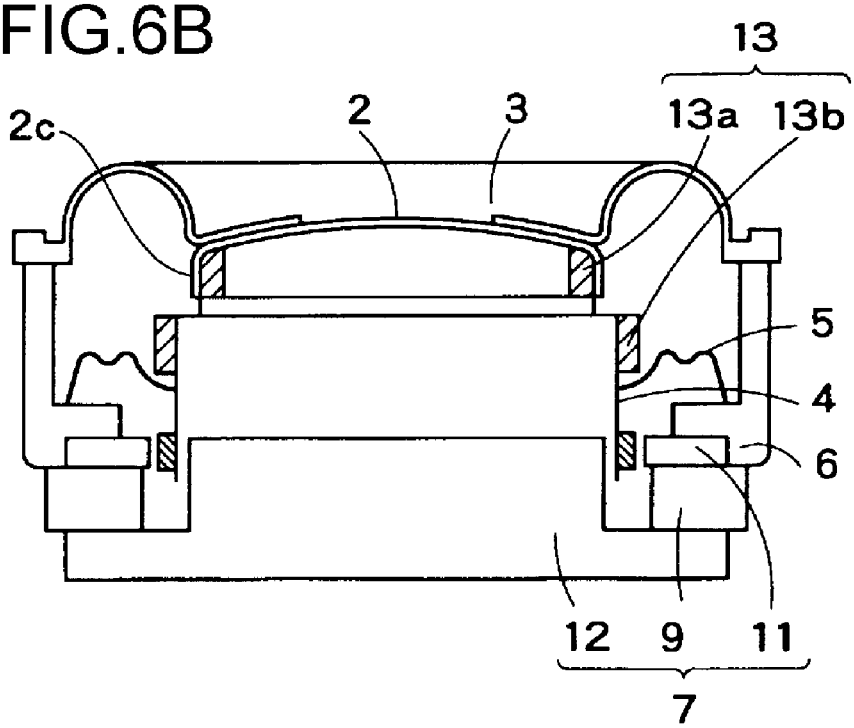
FIG. 6B is a cross sectional view of the speaker including structures shown in preceding drawings, complete with a spider, a frame and an outer magnet type magnetic circuit.

The speaker 1 according to the present embodiment may include an inner magnet type magnetic circuit or an outer magnet type magnetic circuit shown, for example, in FIGS. 6A and 6B, respectively.

Referring to FIGS. 6A and 6B, the speaker 1 includes a spider 5, a frame 6 and a magnetic circuit 7 in addition to the coupling member 13, the diaphragm 2, the surround 3 and the voice coil bobbin 4 described above.

The magnetic circuit 7 in FIG. 6A is an inner magnet type which includes a pot yoke 8 connected to the inner side of the frame 6, a magnet 9 disposed inside the pot yoke 8, and a pole piece 10 disposed at the front face of the magnet 9.

On the other hand, the magnetic circuit 7 in FIG. 6B is an outer magnet type which includes a top plate 11 disposed around the voice coil bobbin 4, a bottom yoke 12 disposed rearward of the frame 6, and a magnet 9 disposed between the top plate 11 and the bottom yoke 12.

Whether the magnetic circuit 7 is an inner magnet type or an outer magnet type, the coupling member 13 structured as shown in FIGS. 1 to 3D can be successfully applied while the diaphragm 2, the voice coil bobbin 4 and the surround 3 are arranged the same as in FIG. 1. Consequently, the diameter of the voice coil bobbin 4 can be readily increased and also the bass reproductive performance can be enhanced.

In FIGS. 1 to 5B, the three protrusions 2*a* are formed at the rear side of the diaphragm 2, and the two coupling members 13 are fixedly disposed each between adjacent two of the three protrusions 2*a*. However, when only one voice coil bobbin 4 is used, the diaphragm 2 is arranged to have two of the protrusions 2*a*. That is to say, the diaphragm 2 is to have at least two of the protrusions 2*a*. The distance between two adjacent protrusions 2*a* is set to the outer dimension of the forward segment 13*a* of the coupling member 13 measured along the major axis direction.

The present embodiment can be applied also when three or more voice coil bobbins 4 are used. In this case, the diaphragm 2 is arrange to have protrusions 2*a* as properly proportional in number to the number of the voice coil bobbins 4, wherein the coupling member 13 is provided for each of the voice coil bobbins 4.

Figure 7:
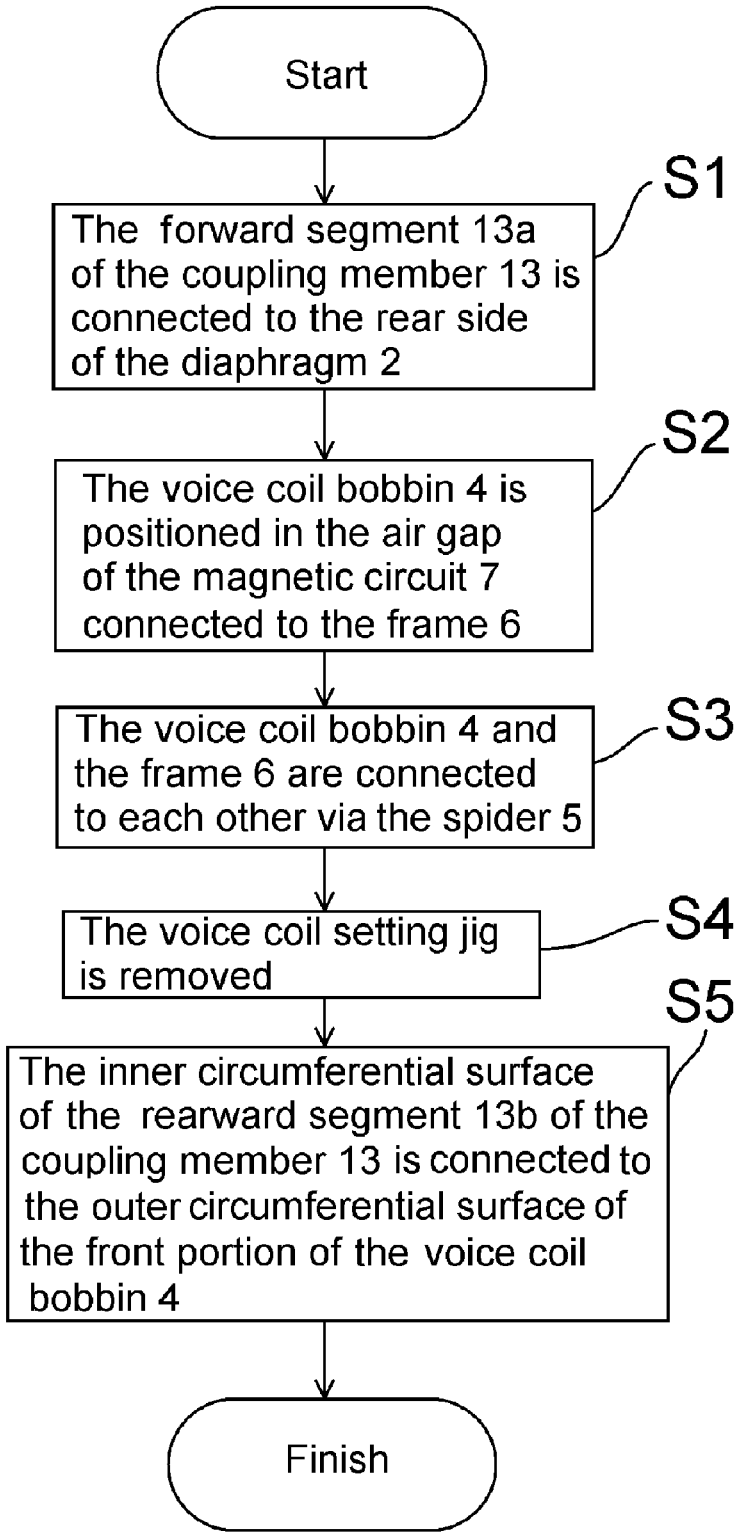
FIG. 7 is a flow chart of an example production process of the speaker according to the embodiment.

FIG. 7 shows an example production process flow of the speaker 1 according to the embodiment. The production process flow of the speaker 1 will be described with reference to FIG. 7.

First, the forward segment 13*a* of the coupling member 13 is connected to the rear side of the diaphragm 2 (Step S1). Next, the voice coil bobbin 4 having the voice coil 4*a* wound therearound is positioned in the air gap of the magnetic circuit 7 connected to the frame 6 (Step S2). Since this positioning work must be precisely performed, the voice coil bobbin 4 is previously attached to a voice coil setting jig (not shown) and inserted together in the air gap of the magnetic circuit 7. Then, the voice coil bobbin 4 and the frame 6 are connected to each other via the spider 5 (Step S3), and the voice coil setting jig is removed (Step S4).

Subsequently, adhesive is applied either to the outer circumferential surface of the front part of the voice coil bobbin 4 or to the inner circumferential surface of the rearward segment 13*b* of the coupling member 13, and the inner circumferential surface of the rearward segment 13*b* of the coupling member 13 which has gone through Step S1 described above is connected to the outer circumferential surface of the front part of the voice coil bobbin 4 (Step S5). Thus, the speaker 1 of FIG. 6A or 6B is finished. Step S1 may be performed after Steps S2 to S4 are done.

The technical feature of the speaker 1 according to the embodiment described above is characterized as follows. The diaphragm 2 has an elongated shape and includes at least two protrusions 2*a* formed at the rear side thereof along the major axis direction. The forward segment 13*a* of the coupling member 13 is connected to two opposing end faces of two adjacent protrusions 2*a* also to two portions of the rib 2*c* opposing each other in the minor axis direction of the diaphragm 2. And, the outer circumferential surface of the voice coil bobbin 4 is connected to the inner circumferential surface of the rearward segment 13*b* of the coupling member 13. With the structure described above, the voice coil bobbin 4, which has a dimension (diameter) larger than the dimension of the diaphragm 2 with respect to the minor axis direction, can be fixedly attached to the diaphragm 2 via the coupling member 13.

Since the inner circumference of the surround 3 is connected to a portion of the front side of the diaphragm 2 located inward of the outer periphery of the diaphragm 2, the width of the surround 3 is not forced to decrease even if the outer dimension (diameter) of the coupling member 13 is increased, and therefore the diameter of the voice coil bobbin 4 can be successfully increased without decreasing the width of the surround 3 thereby increasing the withstanding of power input. And, since the width of the surround 3 does not have to be decreased, the lowest resonance frequency can be kept low thus enhancing the bass reproductive performance.

Figure 8:
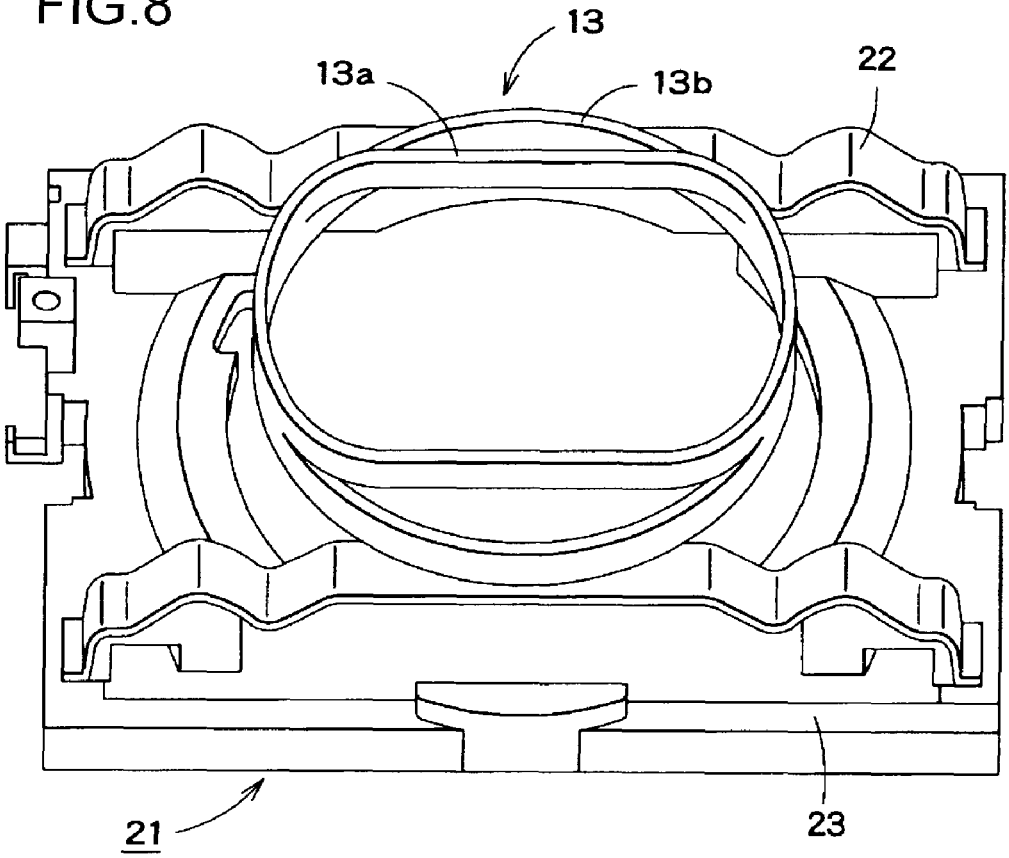
FIG. 8 is a perspective view of an example of composite unit in which a spider is formed integrally with a coupling member.

In the embodiment described above, the coupling member 13 and the spider 5 are discrete from each other, but the present invention is not limited to such a discrete structure and the coupling member 13 and the spider 5 may alternatively be structured in an integrated manner. FIG. 8 shows perspectively a composite unit 21 which is formed by molding so as to integrally include the coupling member 13, a plurality (four in the embodiment) of spider legs 22 as spider constituent elements functioning as a spider, and a spider support base 23 to be connected to the inner circumferential surface of the frame 6, wherein the coupling member 13 is centrally located and suspended by the spider legs 22 supported on the spider support base 23, specifically such that one end of each spider leg 22 is connected to the rearward segment 13*b* of the coupling member 13 and the other end thereof is connected to the spider support base 23.

When the composite unit 21 of FIG. 8 is used, the process of attaching the spider 5 separately from the coupling member 13 is eliminated thus simplifying the speaker assembly process and improving the workability in the production.

Figure 9:
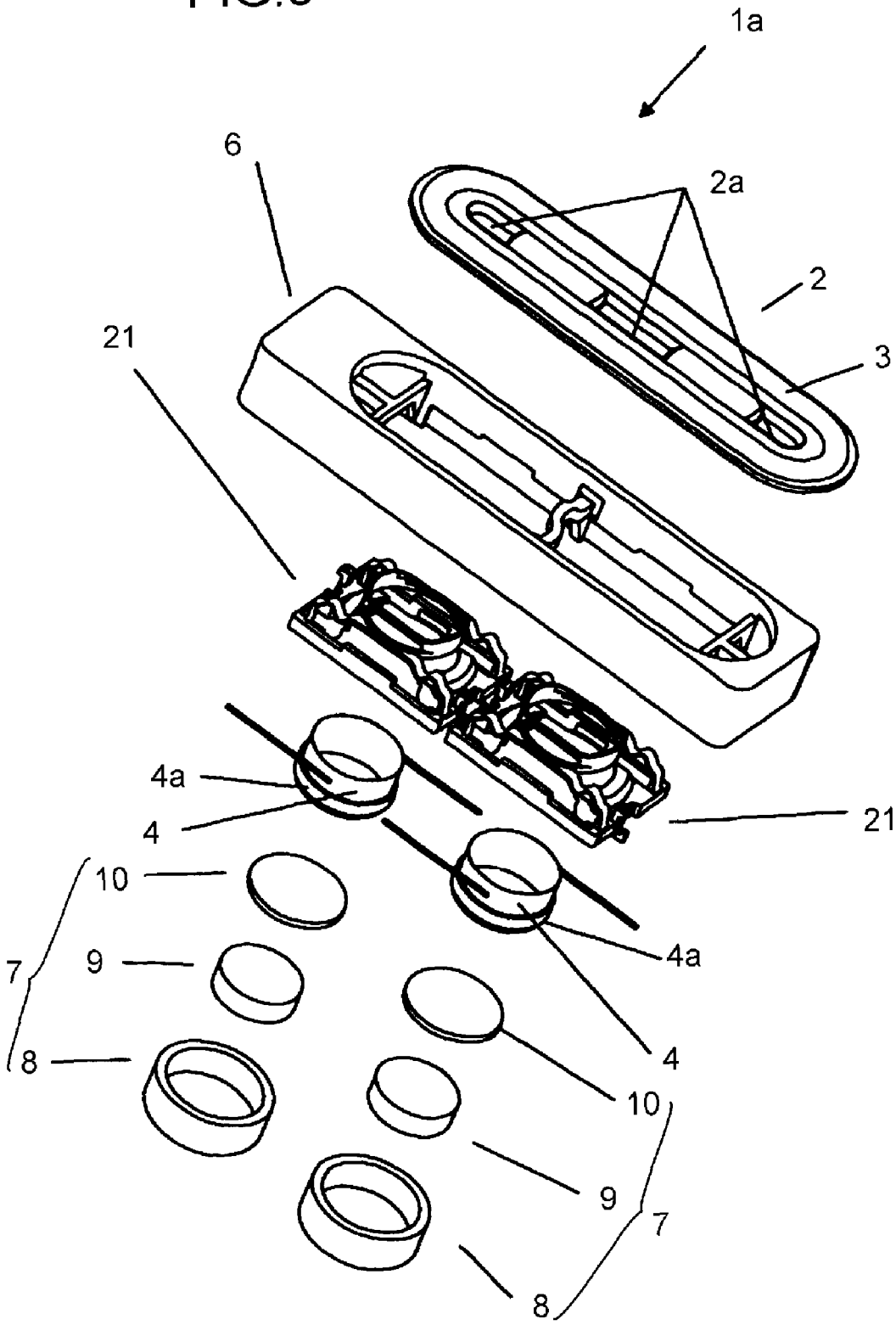
FIG. 9 is an exploded perspective view of a speaker according to a first variation of the embodiment in which the composite unit of FIG. 8 is attached to the diaphragm shown in FIG. 1.
Figure 10:
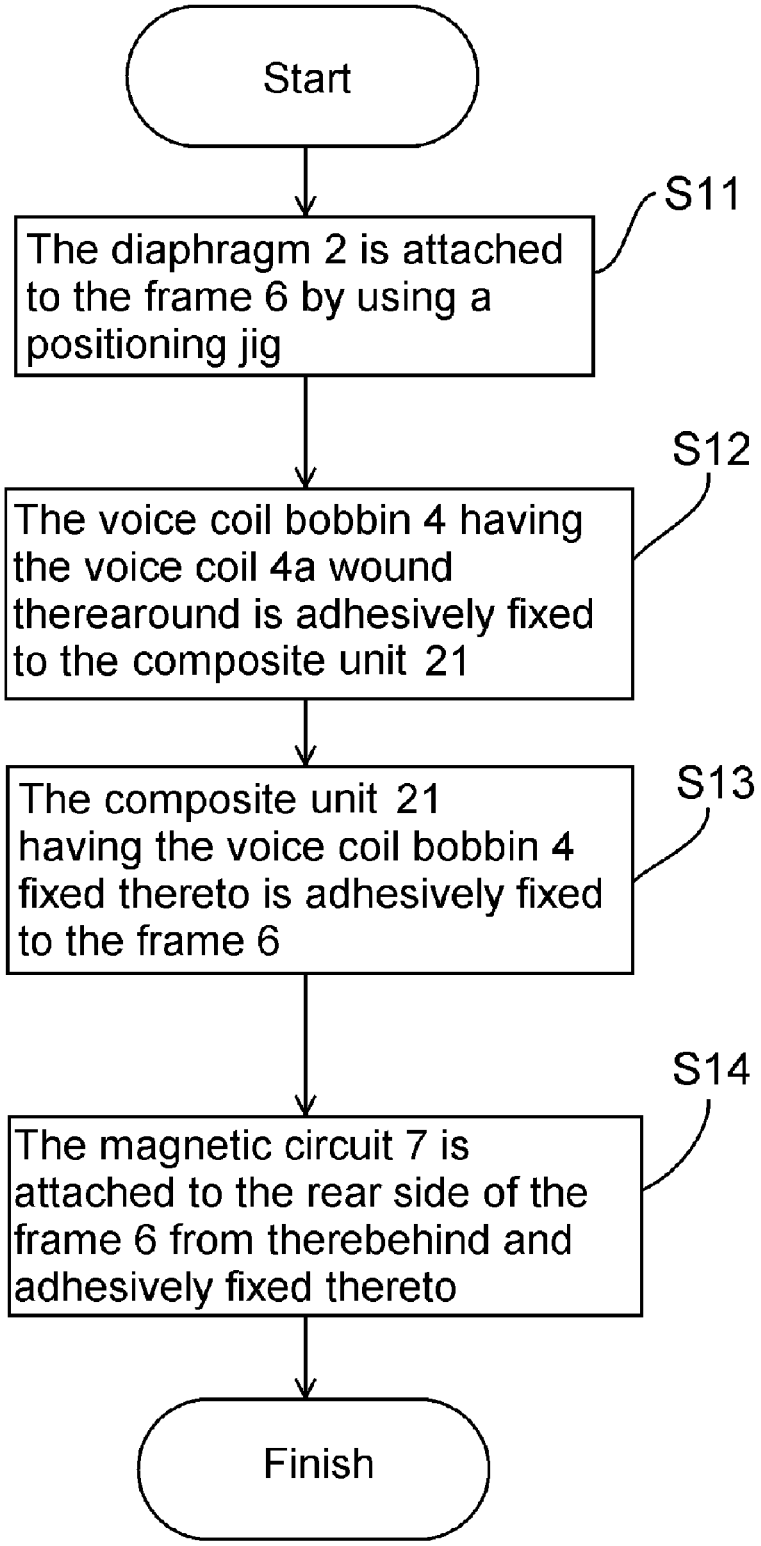
FIG. 10 is a flow chart of an example production process of the speaker of FIG. 9.

FIG. 9 shows perspectively a speaker 1*a* according to a first variation of the embodiment in an exploded manner in which the composite unit 21 of FIG. 8 is attached to the diaphragm 2 shown in FIG. 1 and so on, and FIG. 10 shows an example production process flow of the speaker 1*a* of FIG. 9. The production process flow of the speaker 1*a* of FIG. 9 will be described with reference to FIG. 10.

First, the diaphragm 2, to which the surround 3 is previously attached, is adhered to the frame 6 by using a positioning jig (Step S11).

Then, the voice coil bobbin 4 having the voice coil 4*a* wound therearound is adhesively fixed to the composite unit 21 (Step S12), and the composite unit 21 having the voice coil bobbin 4 fixed thereto is adhesively fixed to the frame 6 (Step S13), wherein the composite unit 21 is to properly fit into a predetermined place of the frame 6 by means of the position determining structure of the frame 6.

Subsequently, the magnetic circuit 7 including the pot yoke 8, the magnet 9 and the pole piece 10 is adhesively fixed to the rear side of the frame 6 (Step S14).

Thus, since the composite unit 21 integrally includes a spider (spider legs 22), the process of attaching the spider is eliminated thereby improving the assembly workability.

In the embodiment described above, the diaphragm 2 has three of the protrusions 2*a*, but present invention is not limited to such an arrangement and the diaphragm does not necessarily have to have protrusions.

Figure 11A:
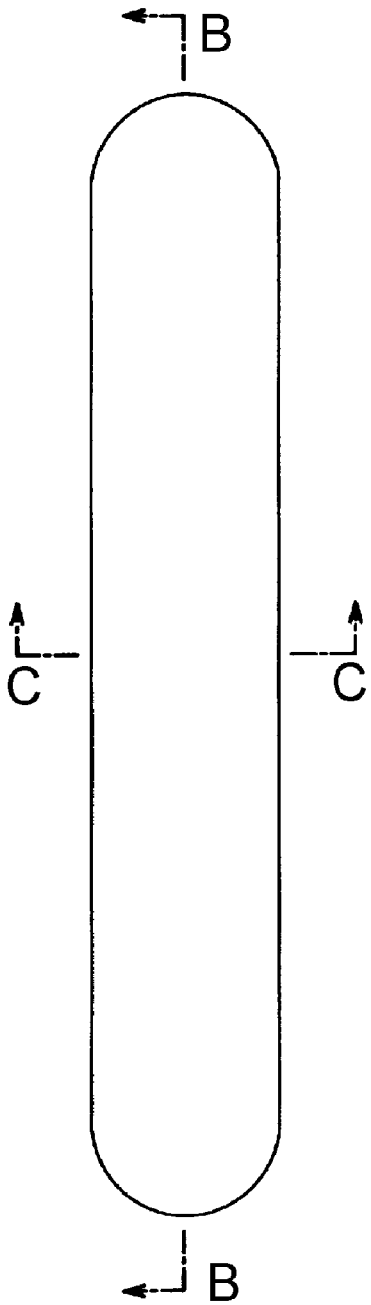
FIG. 11A is a plan view of a diaphragm having no protrusion.
Figure 11B:
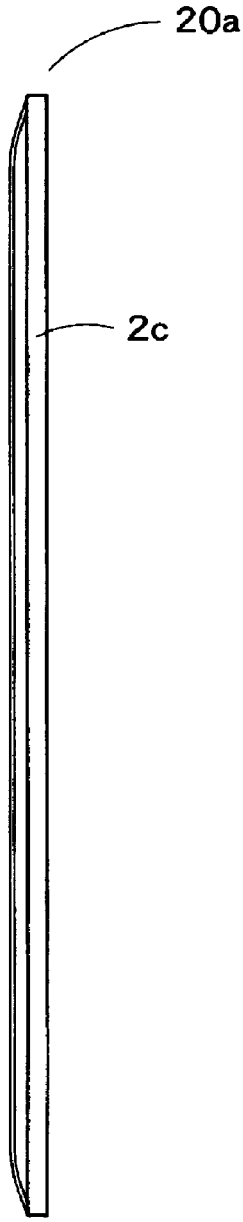
FIG. 11B is a cross sectional view of the diaphragm of FIG. 11A taken along B-B.
Figure 11C:
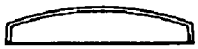
FIG. 11C is a cross sectional view of the diaphragm of FIG. 11A taken along C-C.

FIG. 11A shows a front side of a diaphragm 20*a* having no protrusion, and FIGS. 11B and 11C show cross sections taken along B-B and C-C, respectively.

The diaphragm 20*a* shown in FIG. 11A/11B/11C is gently curved forward so as to have a convex surface at the front side and has no protrusion at the rear side. In the diaphragm 20*a*, the surface of the rear side is curved in line with the convex surface of the front side thus forming a concave surface at the rear side, and the front side of a composite unit 21*a* (refer to FIG. 12) to be adhesively connected to the rear side surface of the diaphragm 20*a* is to be shaped to fit the rear side surface of the diaphragm 20*a* thereby making a full ring-shaped contact therewith.

Figure 12:
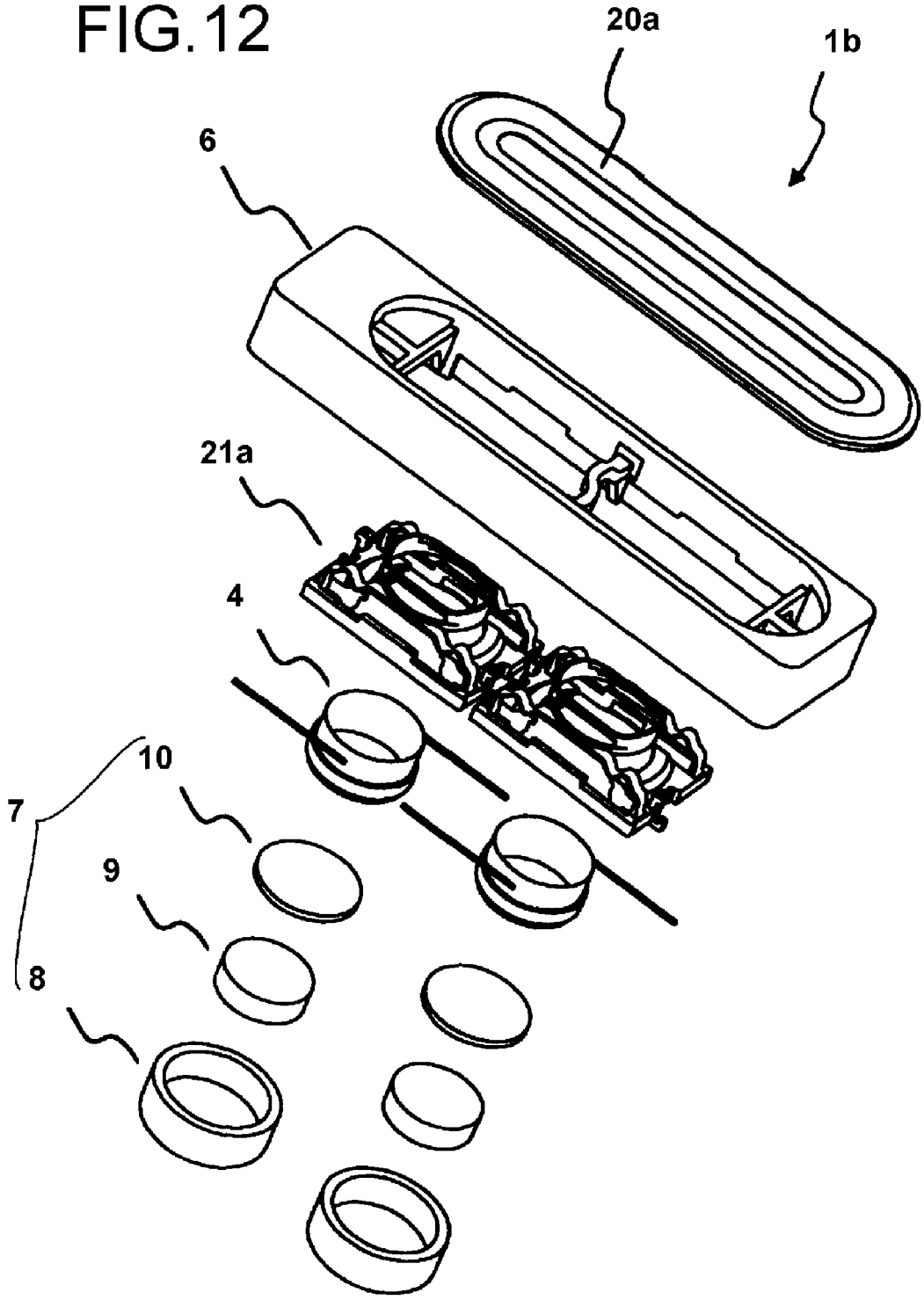
FIG. 12 is an exploded perspective view of a speaker according to a second variation of the embodiment in which the composite unit of FIG. 8 is attached to the diaphragm of FIG. 11A/11B/11C.
Figure 13:
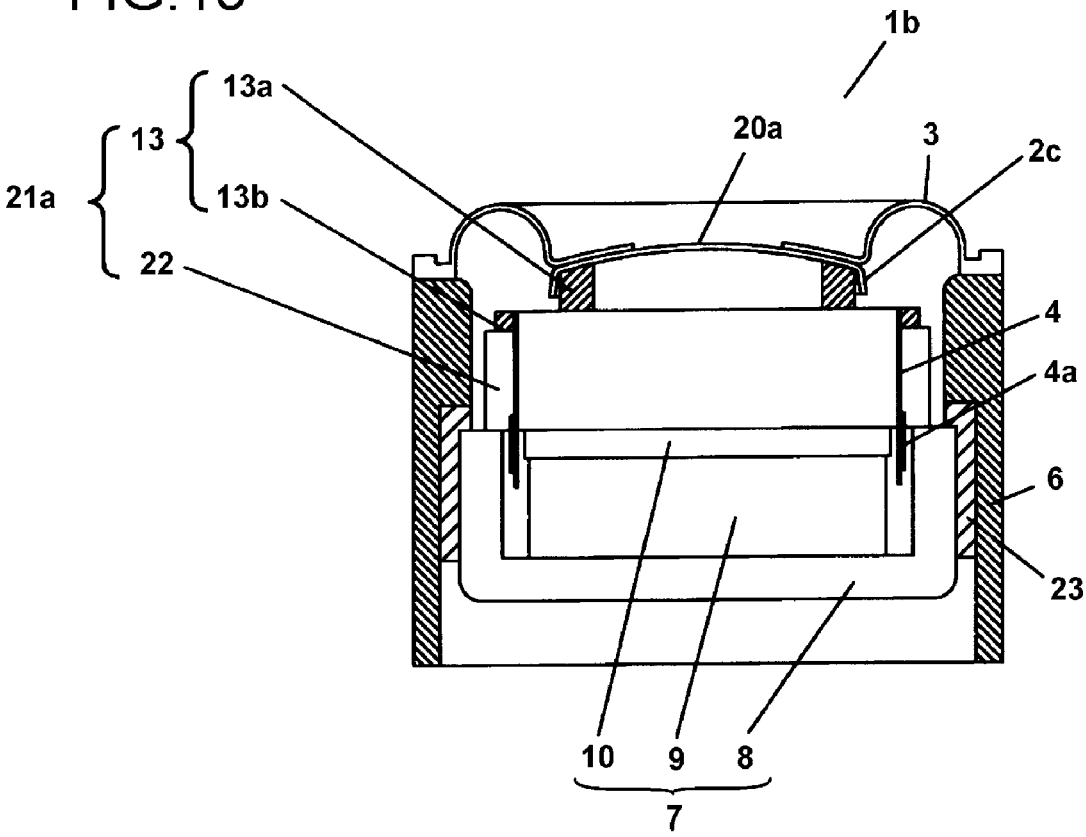
FIG. 13 is a cross sectional view of the speaker of FIG. 12 taken along a minor axis direction.

FIG. 12 shows perspectively a speaker 1*b* according to a second variation of the embodiment in an exploded manner in which the composite unit 21*a* described above is attached to the diaphragm 20*a* of FIG. 11A, and FIG. 13 show a cross section of the speaker 1*b* of FIG. 12 taken along the minor axis direction.

The speaker 1*b* of FIG. 12 is produced in a similar process as shown in the flow chart of FIG. 10. Since the frame 6 has the position determining structure as described above, the composite unit 21*a* is adapted to properly fit into the predetermined place of the frame 6 though no protrusion is provided at the diaphragm 20*a*. Thus, there is no possibility that the voice coil bobbin 4 is shifted in position with respect to the diaphragm 20*a*.

Figure 14A:
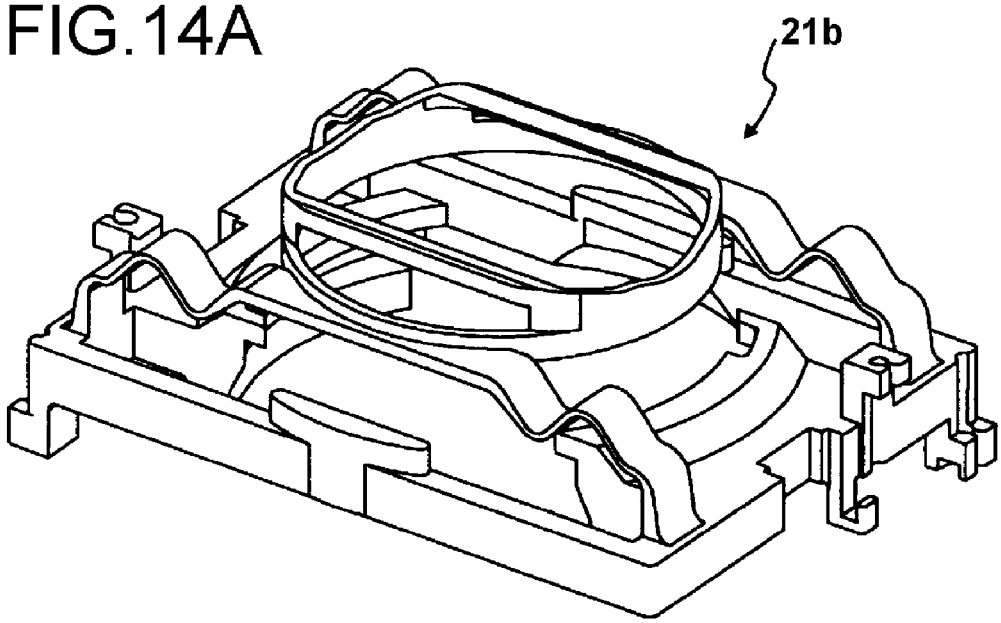
FIG. 14A is a perspective view of a composite unit shaped corresponding to a diaphragm curved rearward so as to have a gently convex surface at the rear side (refer to FIG. 14B)
Figure 14B:
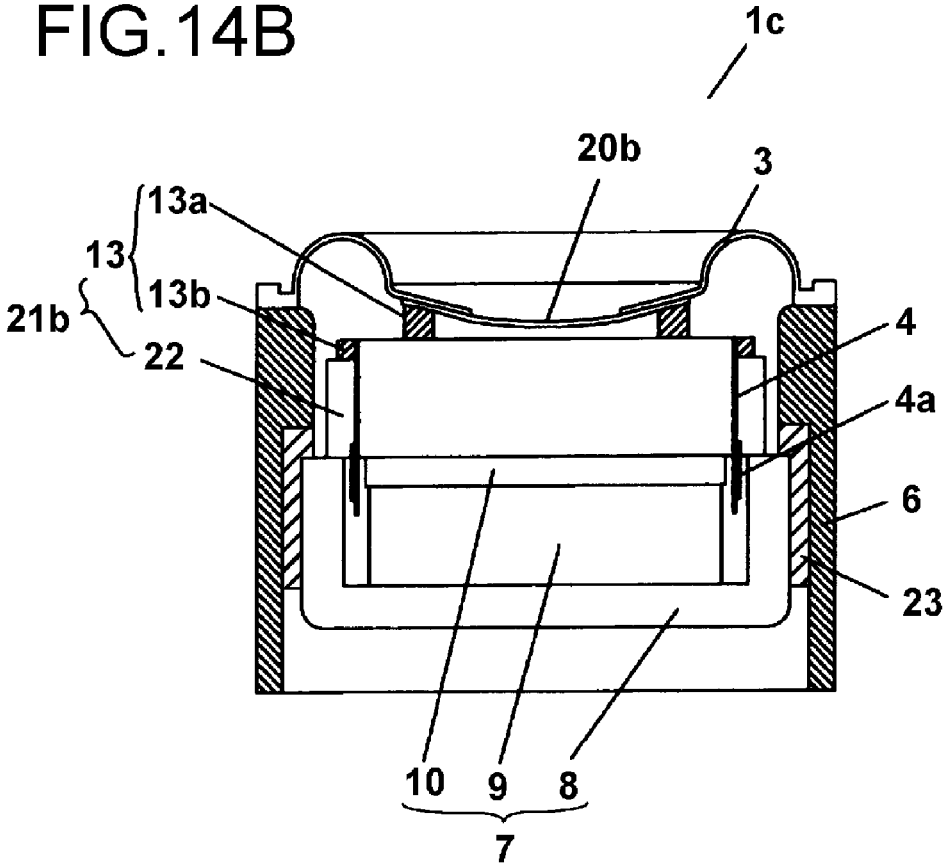
FIG. 14B is a cross sectional view of a speaker according to a third variation of the embodiment in which the composite unit of FIG. 14A is attached to the diaphragm having a gently convex rear surface as described above.

The diaphragm does not have to be curved forward so as to have a convex surface at the front side and may alternatively be, for example, curved rearward so as to have a gently concave surface at the front side. FIG. 14A shows perspectively a composite unit 21*b* configured to be attached to the rear side of a diaphragm 20*b* (refer to FIG. 14B) which has a gently concave surface at the front side thus having a convex surface at the rear side, and FIG. 14B shows a cross section of a speaker 1*c* according to a third variation of the embodiment in which the composite unit 21*b* is assembled to the diaphragm 20*b*.

As shown in FIG. 14A, the front side of the composite unit 21*b* is so shaped as to make a full ring-shaped contact with the convex surface of the rear side of the diaphragm 20*b*. Except for the shape of the front side, the composite unit 21*b* is the same as the composite unit 21.

In the example earlier shown in FIG. 4B, the forward segment 13*a* of the coupling member 13, while making a full contact connection to the rear side of the diaphragm in a ring manner, is connected also to the inner circumferential surface of the rib 2*c* of the diaphragm 2 thereby connecting the coupling member 13 to the diaphragm 2, but the present invention is not limited to such a connection arrangement and a coupling member or a composite unit may alternatively be connected to a diaphragm such that a tip portion of the rib 2*c* of the diaphragm is sandwiched by a part of the coupling member or the composite unit as described hereafter.

Figure 15A:
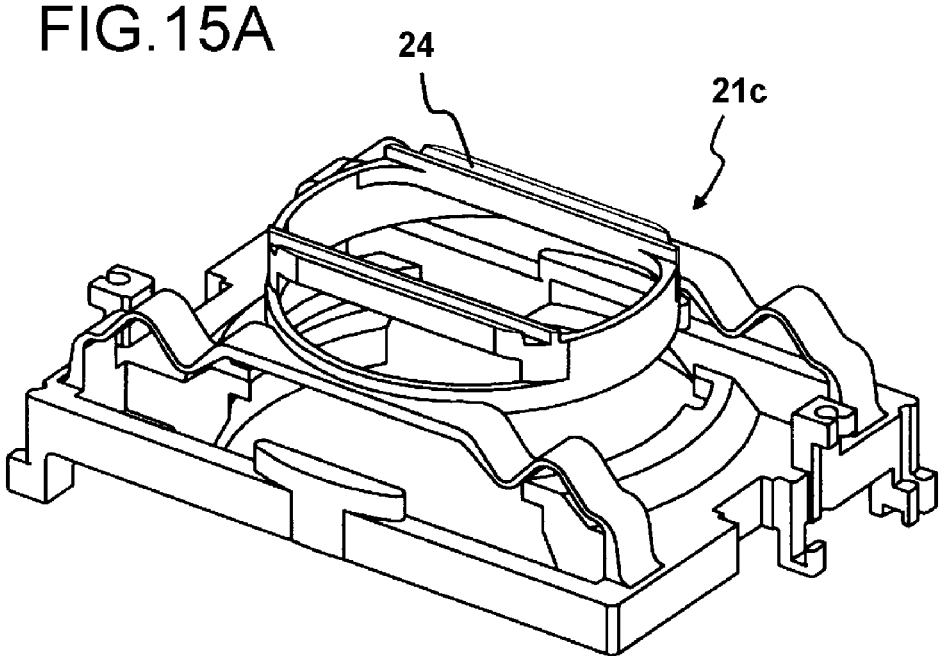
FIG. 15A is a perspective view of a composite unit configured so as to sandwich a tip portion of a rib of the diaphragm for adhesive fixation.
Figure 15B:
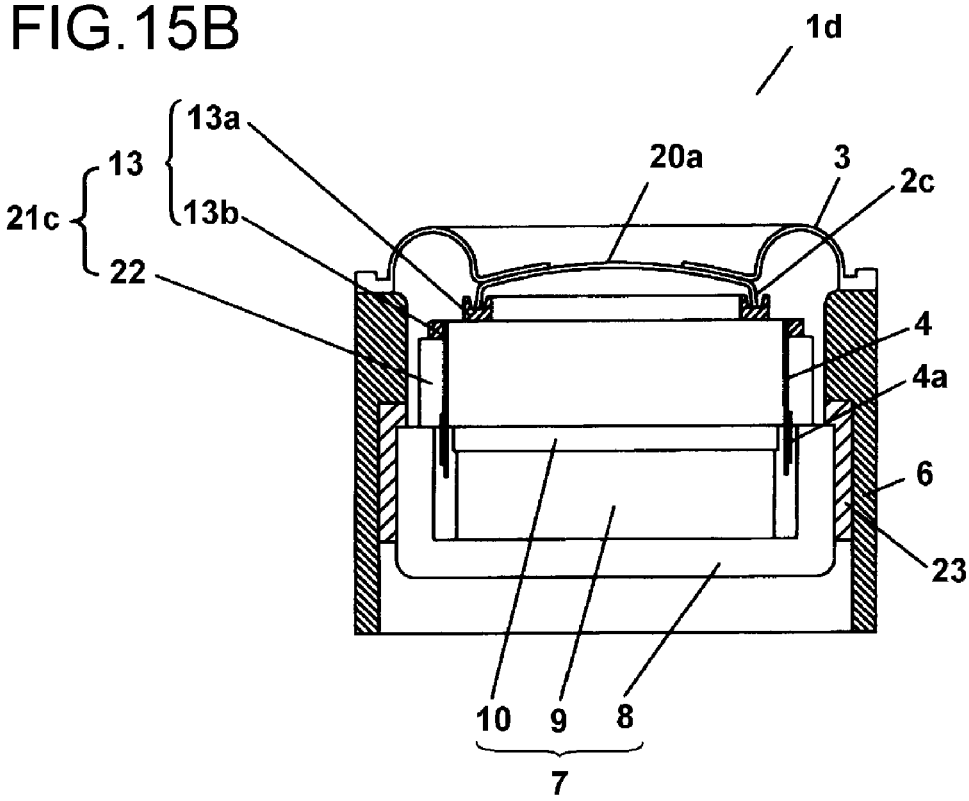
FIG. 15B is a cross sectional view of a speaker according to a fourth variation of the embodiment in which the composite unit of FIG. 15A is attached to the diaphragm.

FIG. 15A shows perspectively a composite unit 21*c* configured to engagingly sandwich the tip portion of the rib 2*c* of a diaphragm for adhesive fixation, and FIG. 15B shows a cross section of a speaker 1*d* according to a fourth variation of the embodiment in which the composite unit 21*c* of FIG. 15A is attached to the diaphragm 20*a*. Referring to FIG. 15A, two grooves 24 each configured to the tip portion of the rib 2*c* are formed respectively at parallel straight portions of the front side of the composite unit 21*c*, and the tip portion of the rib 2*c* is to engage in the groove 24.

Thus, the front side of the composite unit 21*c* is firmly connected to the diaphragm 20*a* by means of the two grooves 24 thus forming a linear contact rather than a ring-shaped contact.

Figure 16A:
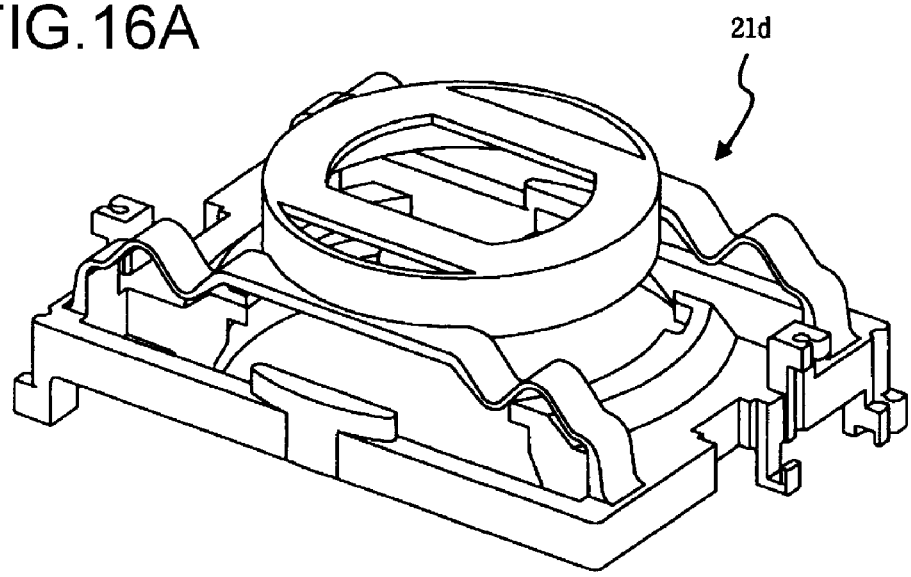
FIG. 16A is a perspective view of a composite unit having a flat front side.
Figure 16B:
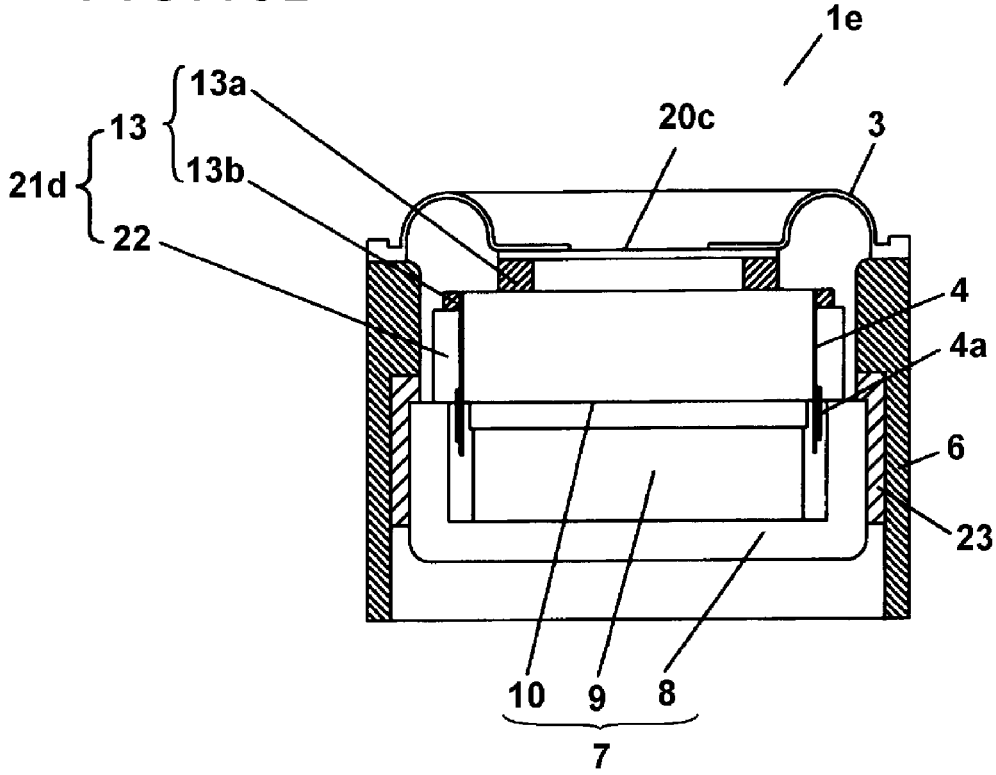
FIG. 16B is a cross sectional view of a speaker according to a fifth variation of the embodiment in which the composite unit of FIG. 16A is attached to a flat diaphragm having a flat surface at the rear side.

The front side of the composite unit and the diaphragm do not necessarily have to be configured or shaped as described above. For example, the diaphragm may be flat so as to have a planar surface at the rear side, in which case the composite unit accordingly is to have a planar face at the front side. FIG. 16A shows perspectively a composite unit 21*d* having a planar front side face, and FIG. 16B shows a cross section of a speaker 1*e* according to a fifth variation of the embodiment in which the composite unit 21*d* of FIG. 16A is attached to a diaphragm 20*c* which is not curved and has a planar rear surface.

Figure 17:
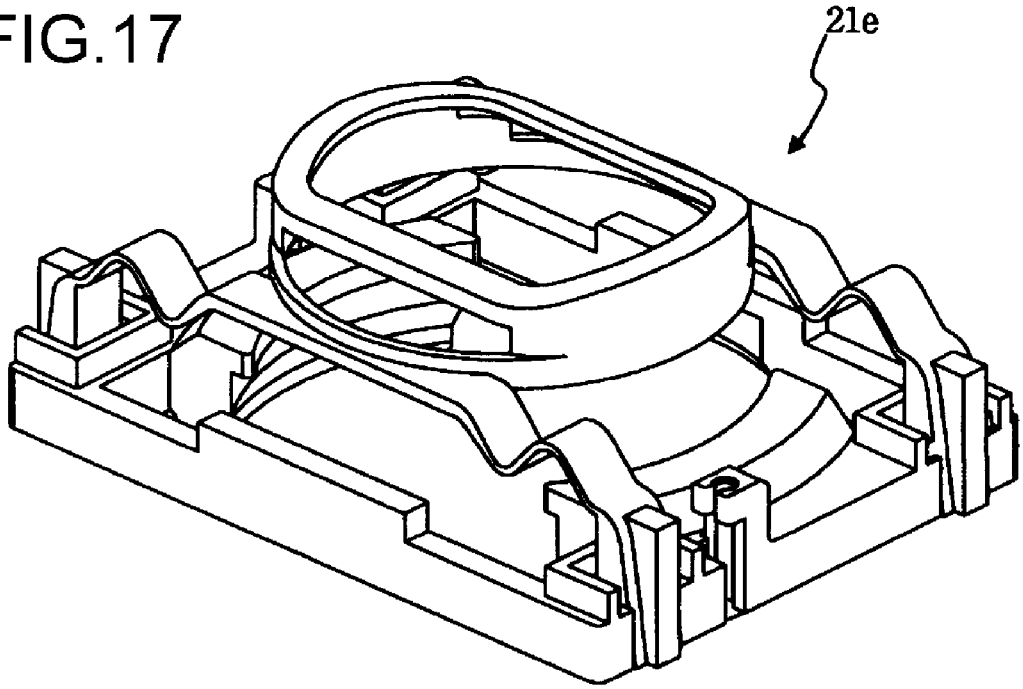
FIG. 17 is a perspective view of a composite unit composed discretely of a first structure and a second structure.

The composite units 21, 21*a*, 21*b*, 21*c* and 21*d* described so far are integrally composed but may alternatively be composed of two structures. FIG. 17 shows perspectively such a composite unit 21*e* that is discretely composed of a first structure 21*f* and a second structure 21*g* (refer to FIGS. 18A and 18B), and FIGS. 18A to 18D show perspectively various aspects of the composite unit 21*e* which in combination explain a production process of the composite unit 21*e*.

Figure 18A:
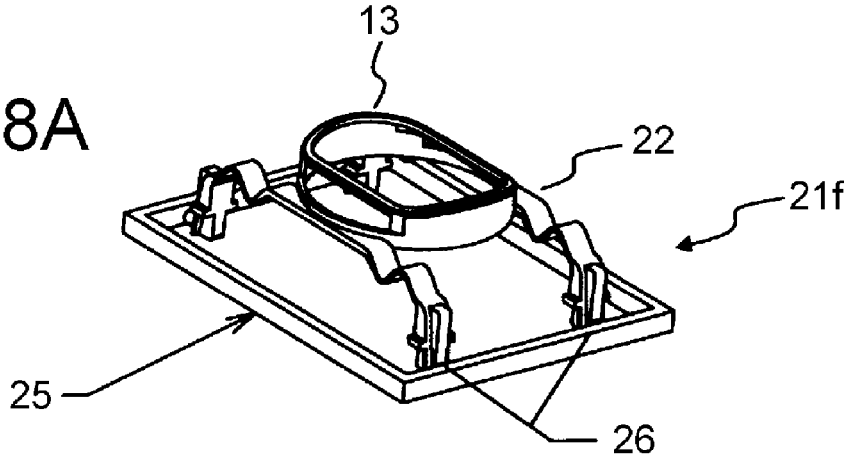
FIGS. 18A to 18D are various perspective views of the composite unit of FIG. 17 which in combination show a production process of the composite unit of FIG. 17.
Figure 18B:
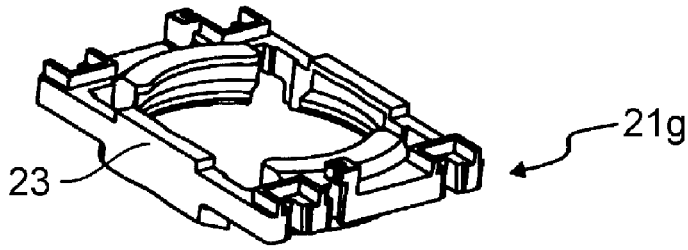

Referring to FIG. 18A, the first structure 21*f* integrally includes: a coupling member 13 to be connected to the diaphragm 2 and also to the voice coil bobbin 4; four spider legs 22; and a temporary frame rack 25. The temporary frame rack 25 includes four claws 26 disposed at an inner side thereof and is connected to the spider legs 22 by means of the claws 26. Referring to FIG. 18B, the second structure 21*g* is structured to engage with the temporary frame rack 25 of the first structure 21*f*.

Figure 18C:
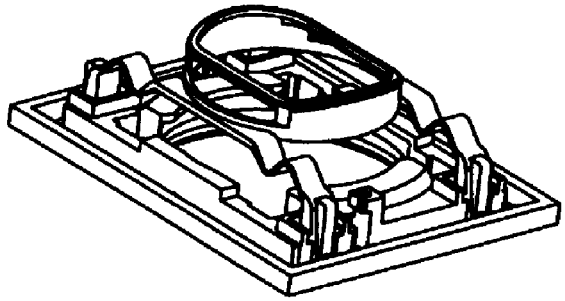
Figure 18D:
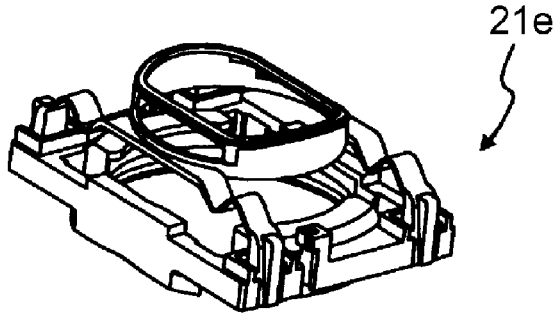

Referring to FIG. 18C, the second structure 21*g* is put inside the temporary frame rack 25 of the first structure 21*f* so as to engage with the inner side of the temporary frame rack 25 and thereby assembled with the first structure 21*f*. Then, the four claws 26 of the temporary frame rack 25 are removed to thereby release the temporary frame rack 25, and the composite unit 21*e* is completed.

The composite unit 21*e* shown in FIG. 17 and FIGS. 18A to 18D is suitably configured for adhesive fixation to a diaphragm having a concave surface at the rear side but can be adhesively fixed to any one of the above described various diaphragms having respective different configurations if the shape of the forward segment 13*a* is appropriately modified.

Figure 19:
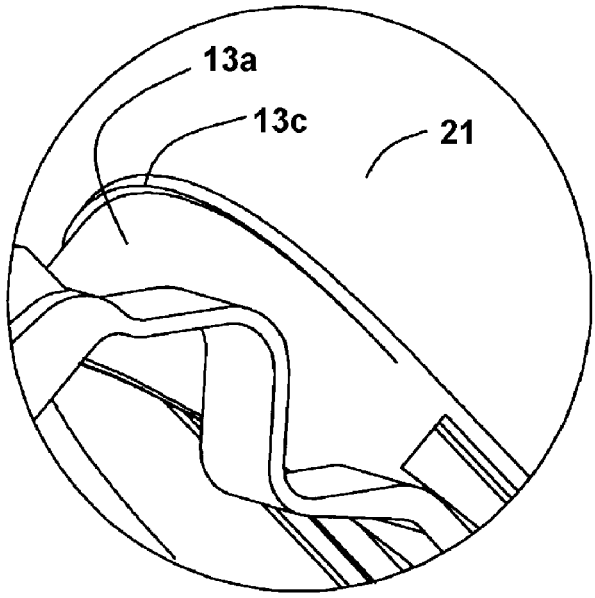
FIG. 19 is an enlarged view of a relevant portion of a composite unit provided with a flange.
Figure 20:
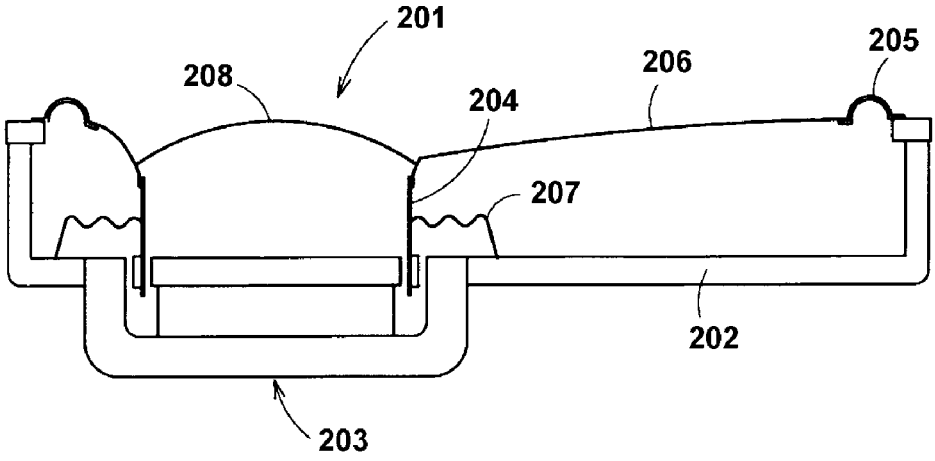
FIG.20 Related Art
FIG. 20 is a cross sectional view of a conventional elongated speaker.
Figure 21A:
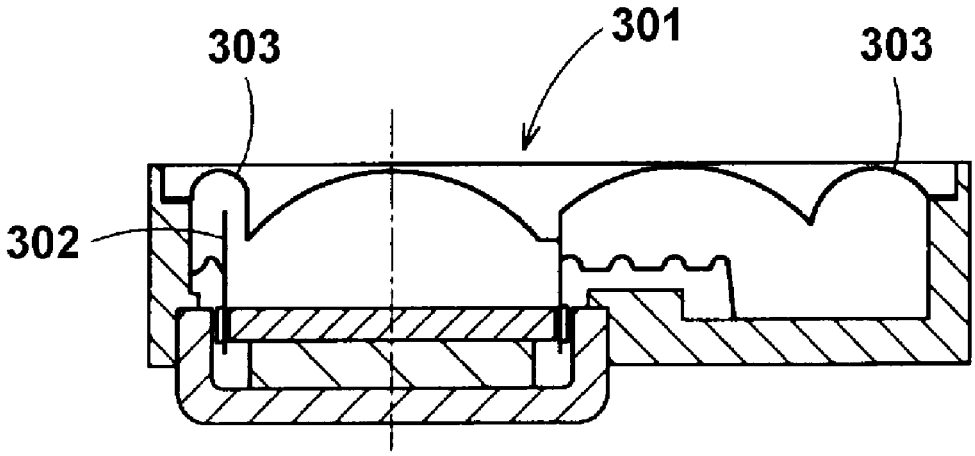
FIG.21A Related Art
FIG. 21A is a cross sectional view of another conventional elongated speaker.
Figure 21B:
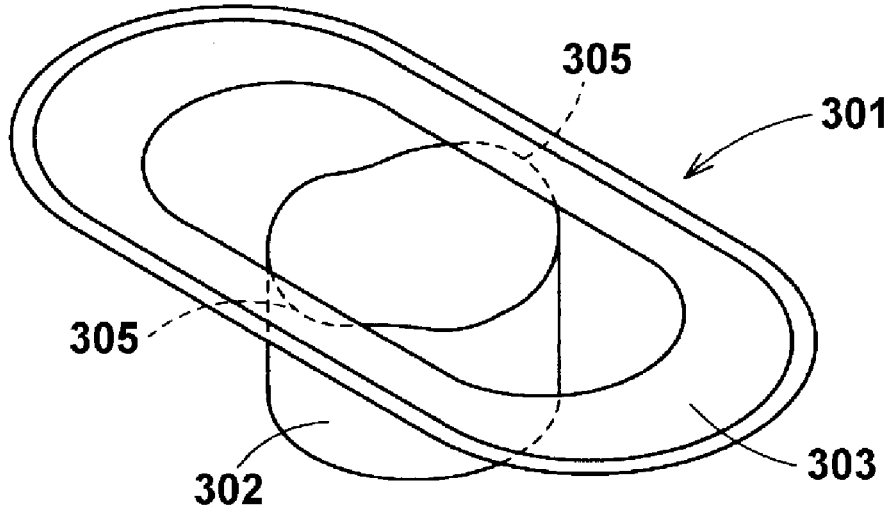
FIG.21B Related Art
FIG. 21B is a schematic perspective view of a relevant portion of the speaker of FIG. 21A.
Figure 22:
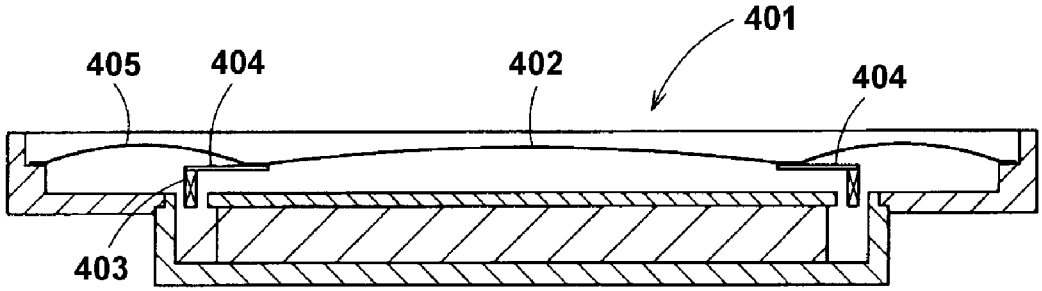
FIG.22 Related Art
FIG. 22 is a cross sectional view of still another conventional speaker.

Moreover, for example, as shown in FIG. 19, the forward segment 13*a* of the composite unit 21 may be provided with a flange 13*c* to be connected to the rear side of the diaphragm. Such provision of the flange 13*c* contributes to increasing the contact area between the composite unit and the diaphragm thus strengthening the connection force therebetween. In FIG. 19, the flange 13*c* is provided at the forward segment 13*a* of the coupling member 13 along both the major axis direction and the minor axis direction of the diaphragm, but the flange 13*c* may be provided only along the major axis direction of the diaphragm.

In the embodiment describe above, the voice coil bobbin 4 as well as the voice coil 4*a* have a circular configuration but may alternatively have a rectangular configuration with rounded edges, a racetrack configuration (two parallel straight lines connected via arc lines), or any other appropriate configurations.

While an exemplary embodiment and variations thereof have been shown and described herein, it is to be understood that the present invention is by no means limited thereto but encompasses all changes and modifications that may occur to those skilled in the art, and also that the effect of the present invention is not limited to what has been described herein. That is to say, various additions, changes and partial omissions for equivalent arrangements may be possible without departing from the spirit and scope of the appended claims.

What is claimed is:

1. A speaker comprising:

a diaphragm having an elongated shape defining a major axis direction and a minor axis direction;

a spider;

a frame disposed outward radially and rearward of the diaphragm;

a surround whose inner circumference is connected to the diaphragm and whose outer circumference is connected to the frame;

a magnetic circuit disposed rearward of the diaphragm and connected to the frame;

a voice coil bobbin;

a voice coil wound around an outer circumferential surface of the voice coil bobbin, and suspended in a magnetic air gap of the magnetic circuit; and a coupling member connected to a rear side of the diaphragm and also to the voice coil bobbin, wherein an outer dimension of the voice coil bobbin measured along the minor axis direction is larger than an outer dimension of the diaphragm measured along the minor axis direction, a front end of the coupling member is connected to the rear side of the diaphragm, and a rear end of the coupling member is connected to the bobbin.

2. A speaker according to claim 1, wherein at least two protrusions are disposed at the rear side of the diaphragm along the major axis direction such that adjacent two of the protrusions are apart from each other at a distance substantially equal to an outer dimension of the voice coil bobbin measured along the major axis direction, and a rib is disposed at an outer periphery of the diaphragm so as to extend rearward.

3. A speaker according to claim 1, wherein the coupling member integrally comprises a forward segment having a ring shape and configured to be connected to the rear side of the diaphragm so as to make either a ring-shaped contact or a linear contact, and a rearward segment having a ring shape and configured to be connected to a front part of the voice coil bobbin.

4. A speaker according to claim 2, wherein the coupling member is disposed between the adjacent two of the protrusions of the diaphragm so as to make contact with opposing end faces of the two adjacent protrusions and also with an inner surface of the rib at two portions opposing each other in the minor axis direction.

5. A speaker according to claim 1, further comprising a spider support base connected to an inner circumferential surface of the frame and adapted to support the spider, wherein the spider is composed of a plurality of spider constituent elements whose one ends are integrally connected to the coupling member and whose other ends are connected to the spider support base.

6. A speaker according to claim 1, wherein the voice coil bobbin has a circular cylindrical shape.

7. A speaker according to claim 1, wherein the voice coil bobbin has one of a rectangular ring shape with rounded edges and an oval racetrack ring shape.

8. A speaker according to claim 3, wherein the forward segment of the coupling member comprises a flange to be connected to the rear side of the diaphragm.

9. A speaker according to claim 1, wherein the coupling member integrally comprises a forward segment contacting the rear side of the diaphragm, and a rear segment contacting a front part of the voice coil bobbin.

10. A speaker according to claim 9, wherein the forward segment contacting the rear side of the diaphragm has a smaller diameter than that of the diaphragm in the minor axis direction, and the rear segment contacting the front part of the voice coil bobbin has a larger diameter than that of the diaphragm in the minor axis direction.

11. A speaker according to claim 1, wherein the front end of the coupling member connected to the rear side of the diaphragm has a smaller diameter than that of the diaphragm in the minor axis direction, and a rear end of the coupling member connected to the bobbin has a larger diameter than that of the diaphragm in the minor axis direction.

* * * * *